US005190602A

United States Patent [19]

Bendersky et al.

[11] Patent Number: 5,190,602

[45] Date of Patent: Mar. 2, 1993

[54] HETEROPHASE TITANIUM ALUMINIDES HAVING ORTHORHOMBIC AND OMEGA-TYPE MICROSTRUCTURES

[75] Inventors: Leonid Bendersky, Gaithersburg; William J. Boettinger, Monrovia; Francis S. Biancaniello, Gaithersburg, all of Md.

[73] Assignee: The United States of America as represented by the Secretary of Commerce, Washington, D.C.

[21] Appl. No.: 808,819

[22] Filed: Dec. 17, 1991

[51] Int. Cl.[5] ..... C22C 14/00

[52] U.S. Cl. ..... 148/669; 148/421; 420/418; 420/421; 420/426

[58] Field of Search ..... 148/669; 420/418, 421, 420/426

[56] References Cited

PUBLICATIONS

Chan, K. S., Jour. of Metals, May 1992.

*Primary Examiner*—Upendra Roy

*Attorney, Agent, or Firm*—James A. Oliff; Steve Faciszewski

[57] ABSTRACT

An alloy comprising titanium, aluminum and niobium has a heterophase microstructure of an orthorhombic, $Ti_2AlNb$, phase and an omega-type, $B8_2$, phase. An alloy is annealed to form the heterophase alloy with the orthorhombic and omega-type phases in thermodynamic equilibrium, and then cooled.

11 Claims, 5 Drawing Sheets

HETEROPHASE TITANIUM ALUMINIDES HAVING ORTHORHOMBIC AND OMEGA-TYPE MICROSTRUCTURES

FIELD OF THE INVENTION

The invention pertains to high strength, low-density titanium-aluminum-niobium alloys and the microstructure of such alloys.

BACKGROUND

Modern industries which require maximum strength from light weight construction materials have long sought low density structural materials with high temperature strength and low temperature ductility. Titanium aluminide alloys are of particular interest for these industries which employ low density and high strength alloys for use at elevated temperatures.

The microstructure of intermetallic alloys is known to affect the physical properties of the alloy. Artisans have utilized a number of different approaches in the Ti-Al system to produce microstructures composed of ordered intermetallic phases: namely, the $\alpha_2$-$Ti_3Al$ and the $\alpha_2$-$Ti_3Al$+the $\gamma$-TiAl. The combination of several properties (for example, high strength and ductility at elevated as well as room temperatures, fracture toughness and creep strength) is of particular interest in the $\alpha_2$ and $\gamma$ trititanium aluminum alloys well known in the art. More contemporary titanium aluminides have fracture toughnesses which exceed those provided by the earlier $\alpha_2$ and $\gamma$ titanium aluminides.

U.S. Pat. No. 4,292,077 discloses an alloy of the trititanium aluminum type ($Ti_3Al$) comprised of aluminum, niobium and titanium in relative atomic percent compositions of 25 to 27% Al, 12 to 15% Nb and the balance titanium. The patent discloses specific compositional ranges for the $Ti_3AlNb$ alloys which are quite narrow. Furthermore, the physical properties are dependent upon the narrow percent composition of the alloys.

As knowledge of the titanium-aluminum alloy system expanded, a clearer understanding of the relationship between the composition of the alloy and microstructure developed. Therefore, the titanium-aluminum-niobium alloys based on homophase, orthorhombic, $Ti_2AlNb$, microstructure developed from the titanium aluminum alloys. These titanium aluminides are known to have a single phase, orthorhombic crystal structure unlike the ordered, hexagonal, $DO_{19}$, structure of the earlier $Ti_3Al$ alloy as discussed in "The Mechanical Properties of Titanium Aluminides Near Ti-25Al-25Nb", TMS Symposium on Microstructure/Property Relationships in Titanium Alloys and Titanium Aluminides, R. G. Rowe, Oct. 7, 1990. This Symposium paper discloses a titanium-aluminum-niobium alloy composed of a homophase, orthorhombic microstructure. However, although the disclosed titanium alloy had increased room temperature ductility and fracture toughness as compared with the traditional $Ti_3Al$ alloy systems, it was shown to lose effective strength at high temperature.

U.S. Pat. No. 4,983,357 discloses a titanium-aluminum-niobium alloy with improved strength, specifically, a titanium aluminide alloy having excellent room temperature fracture toughness, high-temperature oxidation resistance and high-temperature strength as compared with previous titanium-aluminum alloys. The disclosed alloy contains from 29 to 35 wt. % of aluminum, 0.5 to 20 wt. % of niobium, at least one element selected from the group consisting of 0.12 to 1.8 wt. % silicon and 0.3 to 5.5 wt. % zirconium, the balance being titanium and incidental impurities. The disclosure further reveals that silicon and zirconium function to improve the high-temperature strength of the titanium aluminum alloy and that the absence of silicon and zirconium results in a titanium aluminide which does not have the desired physical characteristics.

A recent attempt to avoid additional impurities while providing superior physical properties in Ti-Al-Nb alloys is disclosed in U.S. Pat. No. 5,032,357. The patent discloses an alloy having from about 18 to 30 atomic percent aluminum, about 18 to 34 atomic percent niobium, with the balance being essentially titanium. The disclosed alloy has a superior combination of fracture toughness and high yield strength up to 1500° F.—"-superior combination" meaning that the alloy has at least as high or higher combined fracture toughness and yield strength than prior art trititanium aluminum alloys. Although the titanium aluminide alloys disclosed contain only the additional element niobium, niobium percentage ranges disclosed are above 16 atomic percent and have a microstructure comprised of the homogeneous orthorhombic phase - $Ti_2AlNb$.

SUMMARY OF THE INVENTION

The invention pertains to a titanium aluminide comprising titanium, aluminum and niobium having a heterophase microstructure comprised of an orthorhombic, $Ti_2AlNb$, phase and an omega-type, $B8_2$, phase. The titanium alloy is annealed at a predetermined, elevated temperature for a predetermined period of time to form the heterophase alloy with the orthorhombic and omega-type phases in thermodynamic equilibrium. The annealed article is then cooled.

The invention provides, for the first time, high-temperature strengthening of the intermetallic titanium aluminide by the omega-type, unshearable phase. The alloy, exhibiting physical characteristics of both the orthorhombic and omega-type phases, has superior mechanical properties including room temperature ductility, high-temperature strength and low density. Such superior, combined physical characteristics make the heterophase titanium aluminide alloys particularly well-suited for aerospace applications.

BRIEF DESCRIPTION OF THE DRAWINGS

FIGS. 2(*a*) and 2(*b*) show $[110]_c$ and $[111]_c$ zone axis orientations, respectively.

FIG. 3*a* is a bright field image; FIGS. 3*b* and 3*c* are dark field images taken with reflections belonging to a single variant of the orthorhombic or $B8_2$ phases, respectively.

FIG. 4*a* is after continuous fast cooling from 1200° C. to room temperature with subsequent annealing at 700° C. for 18 days; and FIG. 4*b* is after slow cooling from 1100° C. to 700° C. and subsequent annealing for 5 days.

FIG. 5*a* is slow cooling from 1100 to 700° C. with following annealing at 700° C. for 5 days; FIG. 5*b* is water quenching from 1200° C. with following annealing at 400° C. for 3 days; and FIG. 5*c* is water quenching from 1100° C. with following annealing at 700° C. for 18 days.

DETAILED DESCRIPTION OF PREFERRED EMBODIMENTS

Figure 1:
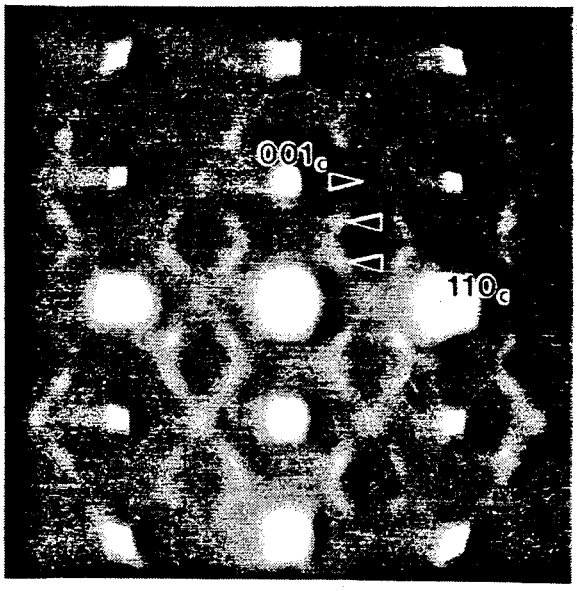
FIG. 1 is a Selected Area Electron Diffraction (SAD) pattern in a orientation taken from the Ti30Al-20Nb B2 phase retained after quenching in water from 1100° C.

The high strength of the titanium-aluminum-niobium alloy containing a homogeneous orthorhombic microstructure, can be increased when alloys are induced, by proper heat treatment, to form a composite of the relatively ductile orthorhombic $Ti_2AlNb$ in a plastically unshearable omega-type $B8_2$ intermetallic phase, the phases being in thermodynamic equilibrium. The series of alloys pertaining to the present invention make use of the omega-type phase in combination with the orthorhombic phase for the first time.

Because the alloys have superior fine microstructure stability at elevated temperatures, they possess good high temperature strength and creep properties.

The alloy according to the present invention comprises titanium, aluminum and niobium has a heterophase microstructure comprised of the orthorhombic, $Ti_2AlNb$, phase and omega-type, $B8_2$, phase. The atomic percent composition preferably ranges from about 48 to 52% Titanium, from about 28 to 32% Aluminum and from about 16–20% Niobium.

The respective orthorhombic and omega-type phases exist in thermodynamic equilibrium with each other at elevated temperatures. The final volume ratio of the orthorhombic to omega-type phase is dependent upon the specific atomic composition of the three elements. An example of the range of the ratio of the orthorhombic to omega-type phase includes, but is not limited to, from about 99:1 to about 1:99.

The alloy according to the present invention has a crystalline microstructure stable against coarsening. Exemplary crystal sizes for the microstructure are within the range of, but are not limited to, from about 0.25 μm to 1.5 μm. Preferably, the crystal size is about 1.0 μm.

Studies of the resulting mechanical and physical properties of these alloys reveal that these alloys are superior, in combined toughness and ductility, to titanium aluminides based on either the conventional $\gamma$ TiAl, the $\alpha_2$ $Ti_3Al$, the combined $\gamma$ and $\alpha_2$ and the homogeneous orthorhombic or omega-type microstructures. The room temperature microhardness test conducted for alloys treated by different heat treatments, revealed results better than the best results found in the literature for alloys $\alpha_2$ having either the homogeneous orthorhombic or $\alpha_2$ microstructures.

Exemplary alloys prepared according to the invention have Vickers hardness numbers of from about 575 to about 650 for a 1000 g, load and preferably from about 617 to 629 for a 1000 g load. This result is better than the best result found in the literature for orthorhombic or $\alpha_2$ phase based alloys. The best results found for other alloys range from 308 VHN to 470 VHN. In addition, the microstructure of the inventive alloys exhibits structural stability not found in other alloys after prolonged heat treatment. Such microstructural stability increases the functional life of the alloy and prevents premature failure.

The desirable orthorhombic/omega-type heterophase microstructure, can be achieved by thermomechanical treatment.

A process for producing the titanium-aluminum-niobium alloy comprises pre-heating the alloy at a preheating temperature, quenching the alloy to a pre-annealing temperature to form an alloy having a uniform composition, annealing the alloy at a predetermined temperature for a predetermined period of time to form the heterophase alloy having the orthorhombic and omega-type phases in thermodynamic equilibrium and cooling the annealed article.

Examples of effective predetermined temperature ranges over which the phases will form during annealing include, but are not limited to, from about 700° C. to about 900° C., preferably about 700° C.

Examples of treatment times include but are not limited to, from about 2 hours to about 18 days, preferably from about 2 hours to about 5 hours, and more preferably about 3 hours at a temperature of about 700° C.

In the process according to the invention, the different phases can be formed by a displacive kind of transformation coupled with chemical ordering. The phase distribution is controlled by cooling rates. Examples of cooling rates include, but are not limited to, the range of from about 10° C. to about 300° C. per minute, preferably about 15° C. per minute.

Examples of effective pre-heating temperature ranges include, but are not limited to, from about 1100° C. to about 1400° C. The pre-heating step is particularly useful for alloys which have dendritic, non-uniform compositions. The pre-heating is preferably conducted at a temperature which ranges from about 1100° C. to 1150° C., and is preferably carried out for about 3 hours.

Examples of effective pre-annealing temperature ranges include, but are not limited to, from about room temperature to 700° C., preferably the pre-annealing temperature is about room temperature.

The high strength, microstructural stability at elevated temperatures and low density of the alloy according to the present invention make the alloy particularly well-suited for components in vehicles, especially those used in the aerospace industry. Examples of uses of the alloy include, but are not limited to, jet turbine engine components and structural components of an aircraft or spacecraft. The alloy is also useful when in the form of a composite material in metal-matrix composites or as a coating on a metal substrate.

EXAMPLE 1

1. Preparation

An alloy with an atomic percentage composition of 30% Al, 20% Nb and the balance Ti (at %), is prepared according to the present invention in the following manner.

The alloy is arc melted using high purity Ti (22.7 g), Al (7.99 g) and Nb (16.5 g) into a casted ingot form having dimensions of 1 cm diameter and 8 cm long. Sequential remelts are necessary to ensure complete melting of the components. Dendritic microsegregation is eliminated completely by homogenization at 1400° C. for 5 hrs under ⅜ atm gettered argon gas. The sample is then analyzed for O, N and H with 600, 50 and 10 ppm by weight respectively as determined by inert gas fusion (O,N) and vacuum hot extraction (H). Composition of the alloy measured by EDS (X-ray energy dispersive spectroscopy) using SEM is found not to deviate from the nominal composition by more than 0.5 at %.

The homogenized specimen is cut to cm thick pieces and subsequently heat treated at 1100° C. for 24 hrs, water quenched, and then the pieces are separately annealed at 900, 850, 800, 750, 700 and 400° C. and for 77 hours, 77 hours, 77 hours, 9 days, 18 days and 3 days, respectively. Annealing is performed by encapsulating Tantalum foil-wrapped slices in evacuated and Helium-backfilled quartz tubes.

2. Analysis

The microstructure of the alloy in different annealings is studied mainly by means of transmission electron microscopy (TEM). TEM thin foils are prepared by a standard twin-jet electropolishing procedure using a 300 ml methanol, 175 ml n-butanol and 30 ml $HClO_4$ electrolyte at 0° C. Microhardness testing is performed on specimens prepared for optical metallography using a diamond pyramid indenter with a 1000 g load.

A. Microstructure

The diffuse scattering observed in the selected area electron diffraction (SAD) patterns from the B2 phase (FIG. 1) corresponds to an observed tweed structure which represents two displacive modes: (1) shuffles of the $(1\bar{1}0)_3$ planes in the $[110]_c$ direction related to the orthorhombic phase and (2) shuffles (or collapse) of the $(111)_c$ planes in the $[111]_c$ direction related to the $B8_2$ phase [1,2,3].

Figure 2B:
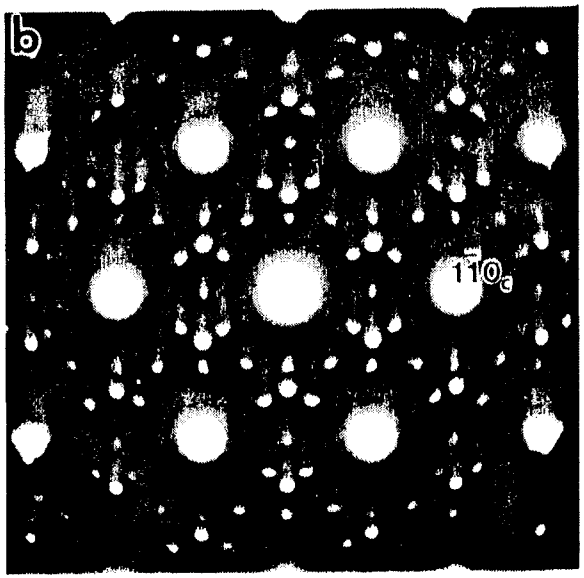
FIGS. 2*a* and 2*b* are SAD patterns taken from the Ti-30Al-20Nb alloy after annealing at 700° C. for 18 days.
Figure 2A:
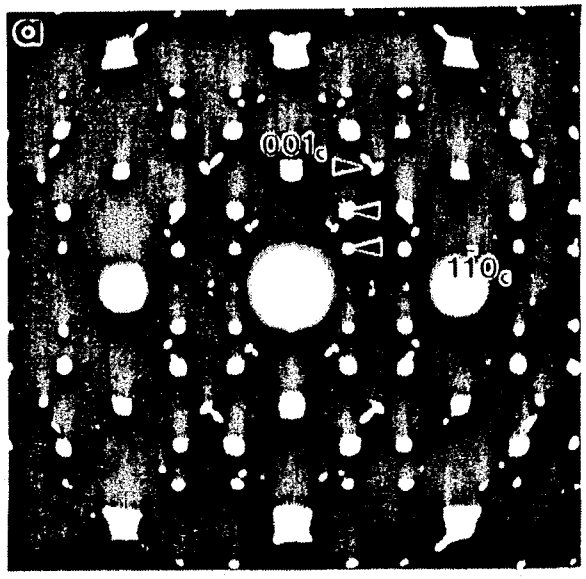

As FIGS. 2 and 3 show, the microstructure obtained for the Ti-30Al-20Nb alloy after annealing at 700° C. for 18 days consists of a homogeneous distribution of fine domains of both the orthorhombic and $B8_2$ phases. The SAD patterns of FIG. 2, taken in (a) $[110]_c$ and (b) $[111]_c$ zone axis orientations, show the presence of reflections from both phases in following orientation relationships (hexagonal (h), $B8_2$, and orthorhombic (o) orthorhombic phase as compared to the transformed B2 (c) phase):

$$(111)_c//(0001)_h;\ [110]_c//[1120]_h - 4 \text{ variants}$$

$$(011_c//(001)_o;\ (211]_c//(110)_o - 6 \text{ variants.}$$

The FIG. 2*b* pattern shows reflections of one of the $B8_2$ variants at the $1/3<112>_c$ position, and a triplet of surrounding reflections which belong to three variants of the orthorhombic phase.

Figure 3C:
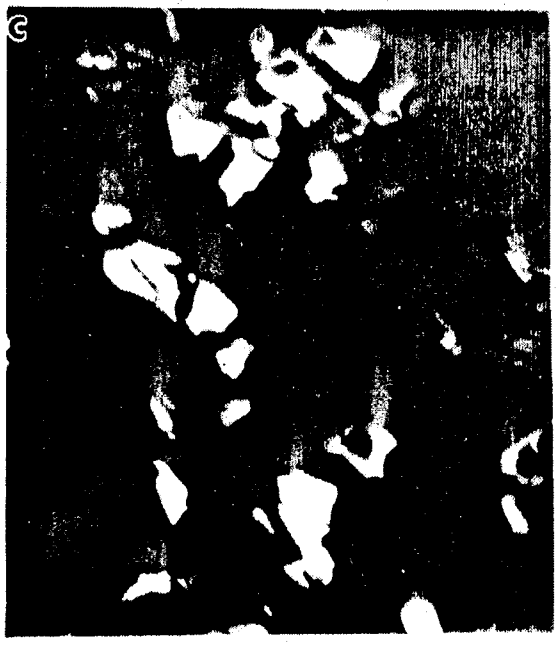
FIGS. 3*a*, 3*b* and 3*c* are Transmission Electron Microscope (TEM) images representing the microstructure of the Ti-30Al-20Nb alloy, after annealing at 700° C. for 18 days, consisting of a homogeneous distribution of fine domains of the orthorhombic and $B8_2$ phases.
Figure 3B:
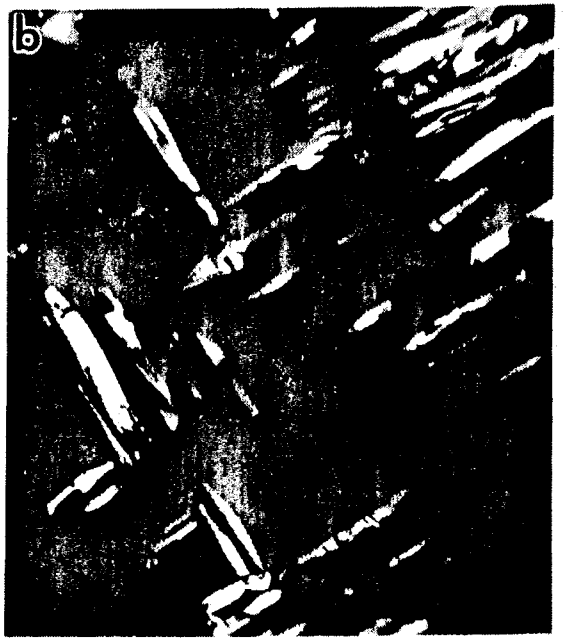
Figure 3A:
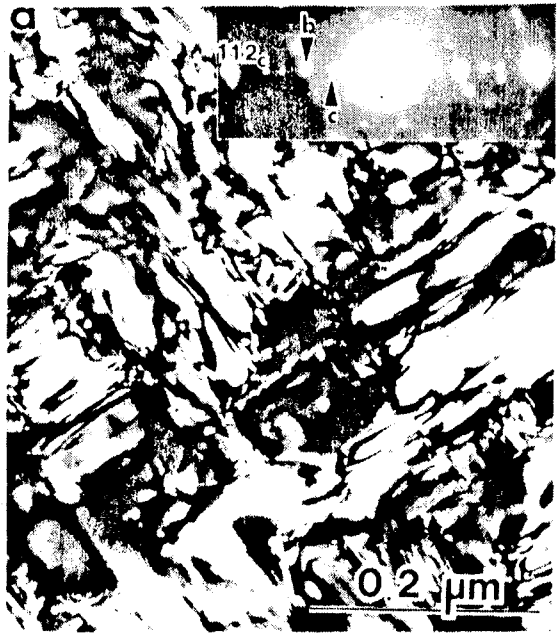

FIG. 3*a* shows a bright field image of the microstructure in the $[110]_c$ orientation, and FIGS. 3*b* and 3*c* show dark field images of the microstructure taken with reflections belonging to a single variant of either (b) the orthorhombic phase or (c) the $B8_2$ phase. The orthorhombic phase appears in a plate-like form (FIG. 3*b*) whereas the $B8_2$ phase exists as round particles (FIG. 3*c*).

Compared to a single orthorhombic phase $Ti_2AlNb$ alloy structure, the two phase structure of the Ti-30Al-20Nb alloy remains fine after annealing for 18 days at 700° C. as FIG. 3 demonstrates. The $Ti_2AlNb$ alloy microstructure recrystallized after a few days (in some specimens after a few hours) at this same temperature.

Figure 4B:
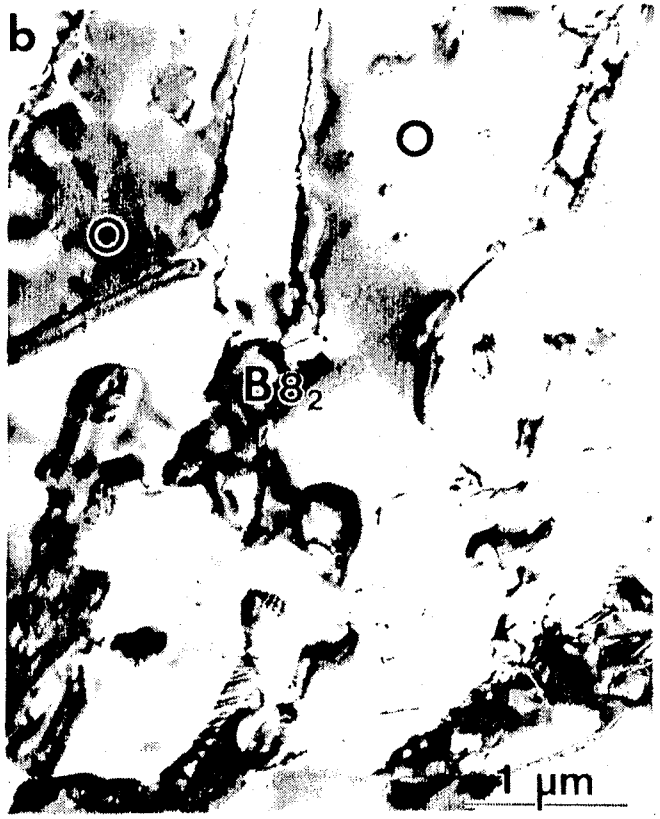
FIGS. 4*a* and 4*b* represent microstructures of the Ti-30Al-20Nb alloy obtained by two different heat treatments, both with a final equilibration at 700° C.
Figure 4A:
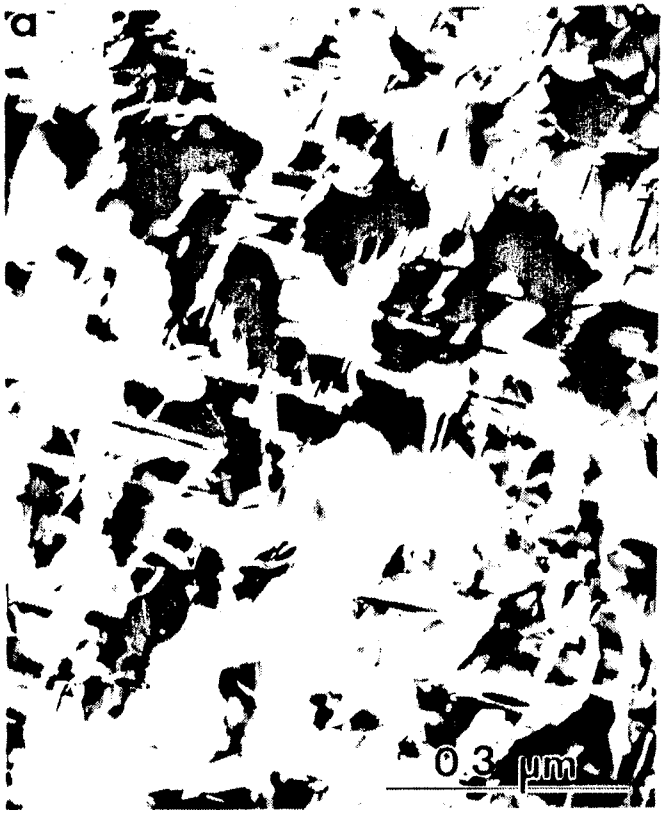

FIG. 4 compares the microstructure obtained by two different heat treatments, both with a final equilibration at 700° C. FIG. 4*a* involves fast cooling (water quenching) from 1200° C. to room temperature with subsequent annealing at 700° C. for 18 days. FIG. 4*b* involves slow cooling from 1100° C. to 700° C. and annealing at 700° C. for 5 days. Even though the second heat treatment was shorter, the orthorhombic $+B8_2$ microstructure is noticeably coarser.

B. Microhardness

Figure 5A:
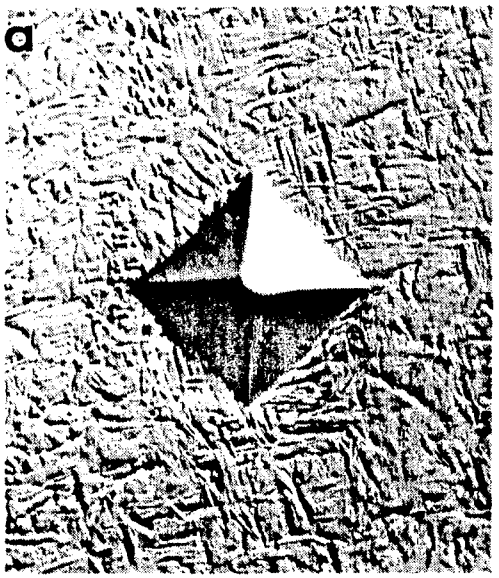
FIGS. 5*a*, 5*b* and 5*c* represent microhardness indentations of the Ti-30Al-20Nb alloy specimens with different thermal histories.
Figure 5B:
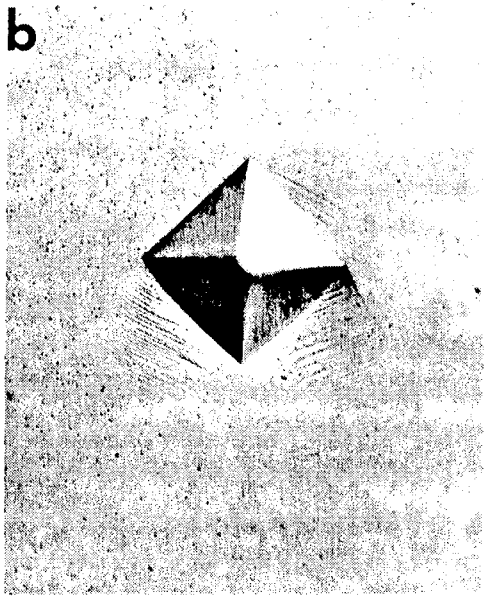
Figure 5C:
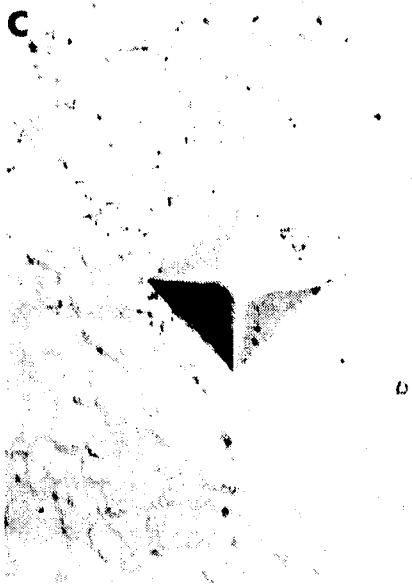

Preliminary room temperature microhardness tests were performed on the Ti-30Al-20Nb alloy following different heat treatments. The best result obtained so far is for a Ti-30Al-20Nb alloy annealed at 700° C. for 18 days: 617–626 VHN for a 1000 g load, without noticeable cracking (FIG. 5*c*). This hardness is higher than the best result found in the literature for alloys based on the orthorhombic phase, Ti-23.5Al-24Nb (308 VHN), and for alloys based on the $\alpha_2$ phase, Ti-(24-26)Al-11Nb (470VHN) and Ti-26.1Al-9.61Nb-2.9V-0.9Mo (440 VHN).

What is claimed is:

1. An alloy comprised of titanium, aluminum and niobium having a heterophase microstructure, in equilibrium, comprised of an orthorhombic, $Ti_2AlNb$, phase and an omega-type, $B8_2$, phase.

2. The alloy according to claim 1, wherein the titanium, aluminum and niobium are present in atomic percentages of from about 48 to about 52% Ti, from about 28 to about 32% Al and from about 16 to about 20% Nb.

3. The alloy according to claim wherein a ratio of the orthorhombic to omega-type phases ranges from about 99:1 to about 1:99.

4. The alloy according to claim 1, wherein the crystal size of the alloy microstructure ranges from about 0.25 μm to about 1.5 μm.

5. The alloy according to claim 1, wherein the crystal size of the alloy is about 1.0 μm.

6. The alloy according to claim 1 having a Vickers hardness number of from about 575 to about 650 for a 1000 g load.

7. The alloy according to claim 1 wherein the heterophase alloy has superior, fine microstructural stability at elevated temperatures.

8. An alloy according to claim 1, in the form of a jet turbine engine component.

9. An alloy according to claim 1, in the form of a structural body component of an aircraft or spacecraft.

10. An alloy according to claim 1, in the form of a composite material in a metal-matrix composite.

11. An alloy according to claim 1, in the form of a coating on a metal substrate.

* * * * *